US012000170B2

(12) United States Patent
Sun et al.

(10) Patent No.: US 12,000,170 B2
(45) Date of Patent: Jun. 4, 2024

(54) CONSTRUCTION STEEL PLATFORM SYSTEM USING TUNED LIQUID DAMPER (TLD) AND TUNED MASS DAMPER (TMD) FOR COMPOSITE TUNED DAMPING

(71) Applicant: Beijing University of Technology, Beijing (CN)

(72) Inventors: Haoding Sun, Beijing (CN); Haoxiang He, Beijing (CN); Bingji Lan, Beijing (CN); Shaosong Li, Beijing (CN)

(73) Assignee: Beijing University of Technology, Beijing (CN)

( * ) Notice: Subject to any disclaimer, the term of this patent is extended or adjusted under 35 U.S.C. 154(b) by 0 days.

(21) Appl. No.: 17/890,223

(22) Filed: Aug. 17, 2022

(65) Prior Publication Data

US 2023/0069323 A1 Mar. 2, 2023

(30) Foreign Application Priority Data

Aug. 29, 2021 (CN) ..... 202110999636.1

(51) Int. Cl.
*E04H 9/02* (2006.01)

(52) U.S. Cl.
CPC ..... *E04H 9/0235* (2020.05); *E04H 9/0215* (2020.05)

(58) Field of Classification Search
CPC ..... E04H 9/0235; E04H 9/0215; E04H 9/021; E04B 2/706; E04B 2/58; E04B 1/98; E04B 1/09; F16F 15/02; F16F 2230/0005
See application file for complete search history.

(56) References Cited

U.S. PATENT DOCUMENTS

2005/0050809 A1* 3/2005 Ju ..... E04H 9/0235 52/167.1
2009/0049767 A1* 2/2009 Georgakis ..... F16F 7/10 52/167.2
2010/0293873 A1* 11/2010 Mualla ..... E01D 11/04 52/167.2

FOREIGN PATENT DOCUMENTS

| | | | | |
|---|---|---|---|---|
| CN | 103541458 A | | 1/2014 | |
| CN | 106193357 A | | 12/2016 | |
| CN | 106760844 A | * | 5/2017 | |
| CN | 107237503 A | | 10/2017 | |
| CN | 206815164 U | * | 12/2017 | |
| CN | 110080088 A | * | 8/2019 | ..... E01D 19/00 |
| WO | WO-2011160438 A1 | * | 12/2011 | ..... E04H 9/02 |

* cited by examiner

*Primary Examiner* — Babajide A Demuren
(74) *Attorney, Agent, or Firm* — Porus IP LLC

(57) ABSTRACT

A construction steel platform system using a tuned liquid damper (TLD) and a tuned mass damper (TMD) for composite tuned damping is provided. According to the construction steel platform system using a TLD and a TMD for composite tuned damping, a composite damper is composed of the TLD and the TMD overlapping each other, and a construction steel platform is placed above the double dampers. By adjusting a hole diameter of a partition plate in the TLD, a liquid level in a water tank, a stiffness of a spring at an edge of a friction support and mass of materials of a top of the steel platform, the whole steel platform system can achieve composite tuned damping. The TLD and the TMD can be flexibly combined in series or in parallel according to requirements of actual wind and earthquake loads.

6 Claims, 4 Drawing Sheets

CONSTRUCTION STEEL PLATFORM SYSTEM USING TUNED LIQUID DAMPER (TLD) AND TUNED MASS DAMPER (TMD) FOR COMPOSITE TUNED DAMPING

CROSS REFERENCE TO THE RELATED APPLICATIONS

This application is based upon and claims priority to Chinese Patent Application No. 202110999636.1, filed on Aug. 29, 2021, the entire contents of which are incorporated herein by reference.

TECHNICAL FIELD

A construction steel platform system using a tuned liquid damper (TLD) and a tuned mass damper (TMD) for composite tuned damping is equipped with a composite damper composed of the TLD and the TMD overlapping each other, and a construction steel platform is placed above the double dampers. By adjusting a hole diameter of a partition plate in the TLD, a liquid level in a water tank, a stiffness of a spring at the edge of a friction support and mass of materials of the top of the steel platform, the whole steel platform system can achieve composite tuned damping. The TLD and the TMD may be flexibly combined in series or in parallel according to requirements of actual wind and earthquake loads, which may more effectively reduce vibration of the construction steel platform system under the wind load or the earthquake load. Water in the water tank and the partition plate may be replaced at any time, a tuned frequency of the TLD is always controlled within a reasonable range, the stiffness of the spring in the TMD is adjustable, and a first-order frequency of the whole construction steel platform system is controlled, so the TLD and the TMD may provide greater damping force. The present disclosure belongs to the technical field of wind resistance, earthquake resistance and damping of civil engineering.

BACKGROUND

In recent years, research on damping methods of super high-rise buildings at home and abroad has become increasingly mature and perfect. For example, a tuned mass damper (TMD) mounted in Taipei 101 and a tuned liquid damper (TLD) mounted in Nanjing TV Tower can effectively control vibration of structures. However, during construction, damping measures of an integral lift-up construction steel platform system need to be studied. The above system has large integral rigidity, and under the action of frequent earthquakes, rod members of the steel platform can probably meet the safety requirements, and stress values fall within the elastic range. However, in the case of rare earthquakes, some rod members of the steel platform begin to enter the plastic stage until they are destroyed. Therefore, it is difficult to guarantee the safety of the structures in the case of an earthquake during construction. Harsh construction environment, closed operation space and absence of escape passages pose a huge threat to life safety of hundreds of construction workers operating at high altitude despite of economic losses. Since current research and application of structural damping control during construction are rare, it is urgent to pay attention to the damping problem and technology research and development for the construction steel platform system in the case of the earthquake or strong wind during construction.

The TLD is a device for passive control of structures, and uses inertial force and viscidity energy dissipation of a liquid in a fixed container on the structures to reduce vibration response of the structures. The TLD not only has the advantages of relatively simple structures, low cost, convenient mounting, desirable automatic activation performance, long service life, low maintenance cost, etc., but can be used as a water supply tank or a fire water tank. It has been increasingly widely applied in practical vibration control and achieved remarkable control effect. In Japan, New Zealand and other countries, the research on the TLD has been going on for a long time, and the TLD has been widely used in buildings. It is shown from all previous earthquakes that the TLD damping system has desirable control over the structures.

The TMD uses a small mass spring system attached to a main structure to absorb vibration energy of the main structure, so as to achieve damping. In the TMD system, a vibration control system composed of springs, dampers and mass blocks is mounted in a certain portion of the building structure. Numerous studies have shown that when a natural vibration frequency of the TMD is consistent with that in a certain vibration mode of the structure, the TMD has the optimal vibration response control effect in this vibration mode, can effectively control the vibration response of the structure and greatly reduce the cost of the structure. It has a wide application prospect in wind resistance and earthquake resistance of high-rise structures at present. Wide application of the TMD has revealed its obvious advantages in practical projects.

However, for a traditional TLD device, when a water tank is subjected to large external excitation, water in the container can slosh greatly, and more violently when the excitation frequency is close to a natural vibration frequency of the water tank, which affects a use function of the structure accordingly. A traditional TMD has the disadvantage of being very sensitive to a natural frequency perturbation of the main structure. In order to improve stability of the TLD, according to proposals of many scholars, the damping ratio of the TLD system can be increased, energy dissipation of the liquid can be increased and the damping by the TLD can be finally enhanced by setting obstacles such as grilles, baffles, columns, etc. inside the water tank. Similarly, for improving stability of the TMD, many scholars put forward and studied multiple tuned mass dampers with distributed frequencies. Some researchers also suggested that the TLD and the TMD should be connected in series one above the other to form a composite tuned damper. The damping performance and stability of the improved composite damper are improved.

Based on the above principle, in the patent, a TLD and a TMD are connected by means of rigid base plates, and overlap each other to form a composite damper, such that the composite tuned damping for the whole steel platform system is achieved, and vibration of the steel platform system under wind or earthquake loads can be more effectively reduced. The upper end of the composite damper is connected to a construction steel platform by means of a rigid base plate, a material stacking area, above the TMD, of the construction steel platform can serve as a mass block in the TMD system, and mass can be increased or decreased by increasing or decreasing construction materials, which achieves flexibility, and improves the material utilization rate. According to the requirements of actual wind and earthquake loads, the TLD and the TMD can be flexibly combined in series or in parallel, which can more effectively reduce vibration of the construction steel platform system under the wind or earthquake loads. The walls on two sides of a TLD water tank are provided with a plurality of elongated gaps, into which partition plates are inserted, and the partition plates can be replaced at any time. The partition plate can improve sloshing of the liquid in the TLD, provide higher additional damping, improve the damping ratio of the TLD system and increase energy dissipation of the liquid. The water in the TLD can also be used as domestic water or fire water, which can solve the problem of water shortage during construction and effectively solve the problem of water space occupation.

When a large earthquake or wind load occurs, the liquid in the TLD water tank starts to slosh, and the liquid flows through the partition plate, which improves the liquid sloshing, provides high additional damping, increases the energy dissipation of the liquid, and thus better reduces the vibration response of the structure. Inside the TMD connected to the TLD one above the other, springs, dampers and mass blocks in the form of construction materials constitute a vibration control system. The system operates in a mechanism that a sliding block in a middle layer of the TMD is made of high-strength materials. Under the action of the earthquake or the strong wind, the circular-arc sliding surface of a lower sliding block moves, and due to the gravity of an upper structure and circular-arc design of the sliding surface, centripetal restoring force can always be produced, and energy can be dissipated by friction between the sliding block and the sliding surface during the ground motion and sliding. The TLD and the TMD are combined to form a composite tuned damper, which has better vibration control effect than that of a common tuned mass damper. In addition, a vibration amplitude of the steel platform system connected to the upper end of the composite damper can be effectively controlled during damping, and sufficient safety and comfort are achieved. Therefore, modified TLD-TMD composite tuned damping construction steel platform system can be fully used to resist sudden earthquake and strong wind in a construction project, so as to reduce casualties and economic losses as much as possible.

SUMMARY

The present disclosure provides a construction steel platform system using a tuned liquid damper (TLD) and a tuned mass damper (TMD) for composite tuned damping. The construction steel platform system may effectively reduce vibration of the steel platform system under a wind load or an earthquake load. According to the present disclosure, the TLD and the TMD are used for composite tuned damping. When the construction steel platform is subjected to the wind load or earthquake load, a liquid in the TLD may slosh in a water tank, and an insertable partition plate may improve the liquid sloshing, provide high additional damping, increase the energy dissipation of the liquid, and thus better reduce the vibration response of the structure. The TLDs are arranged in a distributed manner and are connected to a rigid base plate, an upper end of the rigid base plate is provided with the distributed TMDs, and springs are arranged in the TMD. According to the principle of tuned damping and design requirements, connection stiffness between the steel platform and a building structure is changed by changing a stiffness of springs for connection of an upper friction support plate and a lower friction support plate, such that a natural vibration frequency of the steel platform is close to a first-order natural vibration frequency of the building structure. An upper end of the TMD is connected to the rigid base plate, the rigid base plate then is connected to the construction steel platform, and the complete construction steel platform system is finally formed. In this case, the whole construction steel platform system is equivalent to the composite tuned damper, has a frequency close to the natural vibration frequency of the structure, and may absorb vibration energy to the maximum extent to reduce the vibration of the structure.

In order to achieve the above objective, the present disclosure uses the following technical solution:

The composite tuned damping construction steel platform system using a tuned liquid damper (TLD) and a tuned mass damper (TMD) mainly includes a water tank 1, an outer TMD plate 2, a construction steel platform 3, a rigid base plate 4, a water outlet/inlet 5, a partition plate 6, a partition plate insertion opening 7, a connecting bolt 8, a spring 9, a friction sliding block 10, a steel platform and TLD connecting support 11, a TMD and bottom structure connecting support 12, an upper friction support plate 13, a lower friction support plate 14 and an inner TMD plate 15. The TLD is composed of the water tank 1, the insertable partition plate 6 and the water outlet/inlet 5. The TMD is composed of the outer TMD plate 2, the spring 9, the friction sliding block 10, the upper friction support plate 13, the lower friction support plate 14 and the inner TMD plate 15. The TLD and the TMD may be combined in series or in parallel according to requirements from a structure for a wind load and an earthquake load, to form the complete composite tuned damping construction steel platform system, which is flexible, and may more effectively reduce vibration of the construction steel platform system under the wind load or the earthquake load.

The water tank 1, the insertable partition plate 6 and the water outlet/inlet 5 form the complete TLD, an overall height of the partition plate is controlled to be 0.5-0.8 times the height of the water tank 1, and a water stop is arranged in the partition plate insertion opening to prevent the condition that after the partition plate is inserted, and water is injected into the water tank, water leaks; the partition plate may be replaced at will, the partition plate is provided with a hole, a hole diameter is about equal to 1/20-1/30 of a width of the double-layer partition plates, and may be set according to actual conditions; and TLDs under the construction steel platform system are distributed to form a distributed TLD system, so as to perform damping on the construction steel platform in multiple directions, and absorb vibration energy in multiple directions to a greater extent.

The layer of rigid base plate 4 is arranged on the distributed TLD system and is connected to the distributed TMD system by means of the connecting bolt 8, a planar area of the rigid base plate 4 is more than five times the planar area of a single TLD, and a rigid base plate 4 of the same specification is arranged on the distributed TMD, and is connected to same by means of the connecting bolt 8; a plurality of TMDs are evenly distributed between the two layers of rigid base plates 4 to form the distributed TMD system; the TMD is composed of the outer TMD plate 2, the spring 9, the friction sliding block 10, the upper friction support plate 13, the lower friction support plate 14 and the inner TMD plate 15, where the upper layer of rigid base plate 4 may horizontally slide along the distributed TMD system by means of the upper friction support plate 13; and the large-scale construction steel platform 3 is placed on the upper layer of rigid base plate 4 such that the construction steel platform system may slide horizontally on the rigid base plate 4 to achieve a tuned mass damping function.

A top of the construction steel platform 3 is divided into different functional zones, a portion of the functional zones may be used as material stacking areas, the TMD is merely placed below the material stacking area, mass of building materials in the material stacking area may serve as a mass block of a distributed TMD system, therefore, in different construction stages, a first-order frequency of the construction steel platform system may be further adjusted by increasing or decreasing the mass of the building materials, and a tuned function may be flexibly achieved; the annular friction sliding block 10 is arranged between a lower surface of the upper friction support plate 13 and a top surface of the lower friction support plate 14, and has a thickness being 1-1.5 times the thickness of the lower friction support plate 14; the upper friction support plate 13, the lower friction support plate 14 and the annular friction sliding block 10 form a damping system, and two damping systems are arranged in a vertically symmetric manner to form a damping portion of the TMD; the friction sliding block 10 should be made from high-strength steel, high-strength alloy, etc., whose elastic modulus should be greater than $3.2\times10^5$ $N/mm^2$ and dynamic friction coefficient should not exceed 0.10; and symmetric variable stiffness springs 9 on four sides are arranged between the outer TMD plate 2 and the inner TMD plate 15, a stiffness of the spring 9 may be adjusted in time according to a first-order frequency of a main building structure during construction, and the ratio of the first-order frequency of the whole construction steel platform system above the upper friction support plate of a main platform to the first-order frequency of the main building structure should be controlled to fall within 0.80-1.00.

Since many uncertain factors may be produced in a floor structure under an actual wind load and an actual earthquake load, the TLD and the TMD may be flexibly combined in series or in parallel according to requirements of the wind load and the earthquake load, in the case of the series form, the TMD and the TLD overlap each other without any support, and are connected merely by means of the rigid base plate 4, and since the wind load has a wide spectrum, the series form may broaden a damping range of the spectrum, and this mode may bring desirable damping effect; when the TMD and the TLD need to be combined in parallel, the construction steel platform 3 may be connected to the TLD by means of the steel platform and TLD connecting support 11, the TMD may be connected to a bottom structure under the TLD by means of the TMD and bottom structure connecting support 12, so as to form a parallel type composite tuned damping form; and the steel platform and TLD connecting support 11 and the TMD and bottom structure connecting support 12 may be flexibly disassembled such that the TLD and the TMD may be flexibly changed from the series form to the parallel form, and damping control over the construction steel platform system may be better achieved.

Therefore, firstly, a portion of vibration energy caused by the earthquake load or the wind load is absorbed by liquid sloshing in the distributed TLD, then the remaining vibration energy is further absorbed by friction sliding between the spring and the friction sliding block of the distributed TMD system above the distributed TLD, and the TLD and the TMD constitute a composite tuned damping damper, thereby controlling vibration response of the construction steel platform system to the greatest extent.

Compared with the prior art, the present disclosure has the following advantages:

1) According to the present disclosure, the TLD and the TMD overlap each other to obtain the composite tuned damper such that the damping performance and stability of the damper may be improved, the composite tuned damping effect of the whole steel platform system may be achieved, and the vibration of the steel platform system under the wind load or the earthquake load may be more effectively reduced.

2) According to the present disclosure, on the basis of an original TLD with a square water tank, the tank walls on two sides in a direction of liquid sloshing are provided with the plurality of partition plate insertion openings, and the water stop is arranged in the partition plate insertion opening to prevent the condition that after the partition plate is inserted, and water is injected into the water tank, water leaks. The partition plates may be replaced at any time. The partition plate may improve sloshing of the liquid in the TLD, provide higher additional damping, improve the damping ratio of the TLD system and increase energy dissipation of the liquid. The water in the TLD may also be used as domestic water or fire water, which may solve the problem of water shortage during construction and effectively solve the problem of water space occupation.

3) In the present disclosure, different functional zones are divided at the top of the steel platform, the TMD is placed below the material stacking area, and other functional areas are each merely paved with a layer of steel cover plate. In this way, the mass of the building materials in the material stacking area, that is, the mass of the TMD mass blocks, may be adjusted by means of mass distribution of the material stacking area and other functional areas. Therefore, the tuned mass damper may achieve the optimal effect by adjusting the stiffness of the spring at the edge of a friction support and the mass of the material of the top of the steel platform.

4) According to the present disclosure, the TLD and the TMD may be flexibly combined in series or in parallel according to requirements of actual wind and earthquake loads, which may more effectively reduce vibration of the construction steel platform system under the wind load or the earthquake load.

In the figures: 1—water tank, 2—outer TMD plate, 3—construction steel platform, 4—rigid base plate, 5—water outlet/inlet, 6—partition plate, 7—partition plate insertion opening, 8—connecting bolt, 9—spring, 10—friction sliding block, 11—steel platform and TLD connecting support, 12—TMD and bottom structure connecting support, 13—upper friction support plate, 14—lower friction support plate and 15—inner TMD plate.

DETAILED DESCRIPTION OF THE EMBODIMENTS

Embodiment 1

Specific embodiments of the present disclosure will be described in detail below with reference to accompanying drawings.

Figure 1:
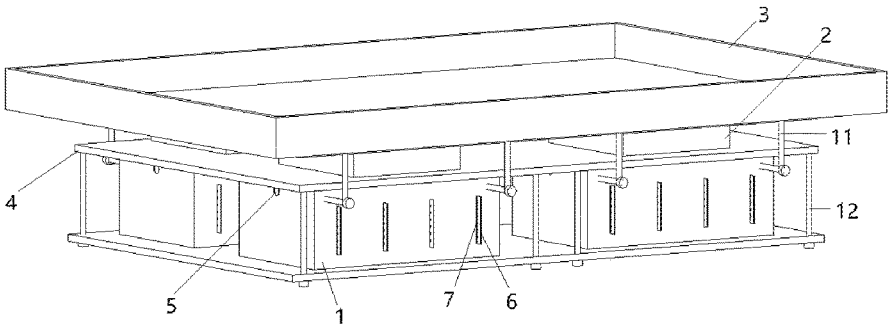
FIG. 1 is a series three-dimensional effect diagram of a construction steel platform system using a tuned liquid damper (TLD) and a tuned mass damper (TMD) for composite tuned damping according to the present disclosure.
Figure 2:
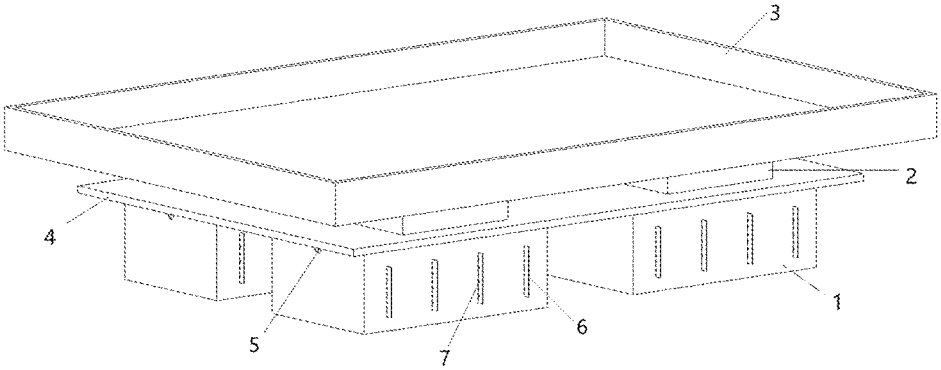
FIG. 2 is a parallel three-dimensional effect diagram of the construction steel platform system using a TLD and a TMD for composite tuned damping according to the present disclosure.
Figure 3:
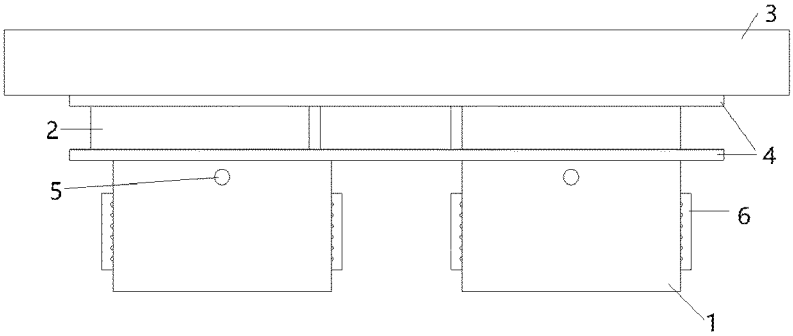
FIG. 3 is a series front view of the construction steel platform system using a TLD and a TMD for composite tuned damping according to the present disclosure.
Figure 4:
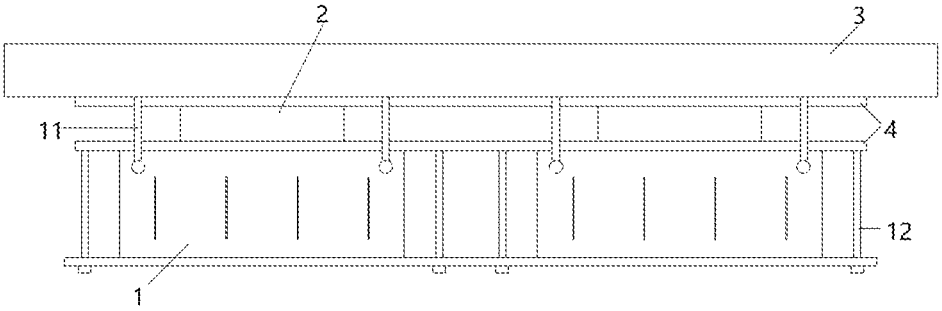
FIG. 4 is a parallel front view of the construction steel platform system using a TLD and a TMD for composite tuned damping according to the present disclosure.
Figure 5:
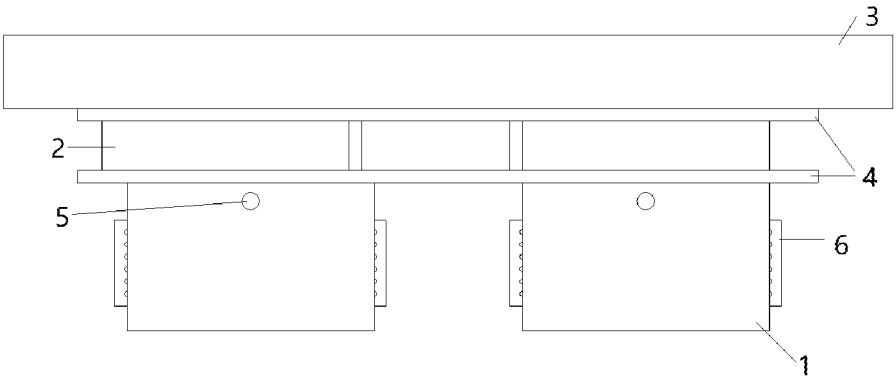
FIG. 5 is a series side view of the construction steel platform system using a TLD and a TMD for composite tuned damping according to the present disclosure.
Figure 6:
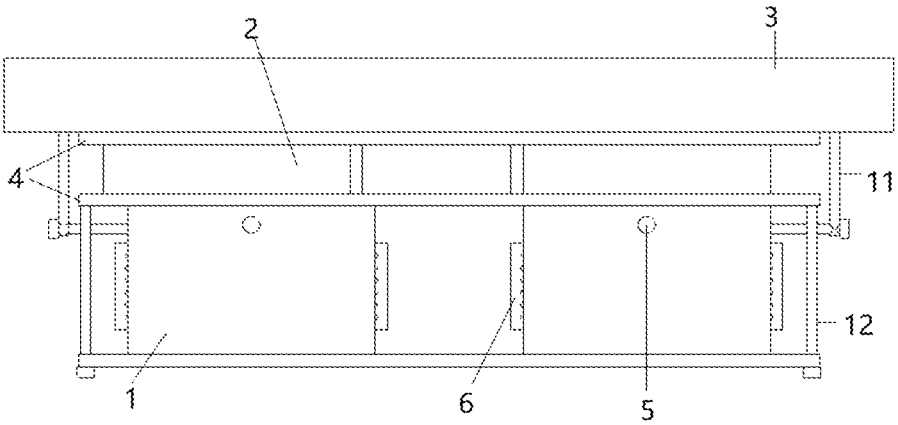
FIG. 6 is a parallel side view of the construction steel platform system using a TLD and a TMD for composite tuned damping according to the present disclosure.
Figure 7:
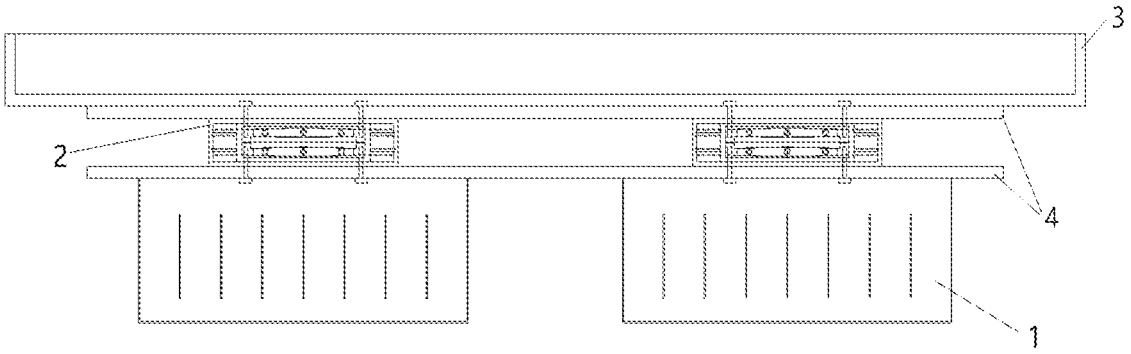
FIG. 7 is an internal cross-sectional view of the construction steel platform system using a TLD and a TMD for composite tuned damping according to the present disclosure.
Figure 8:
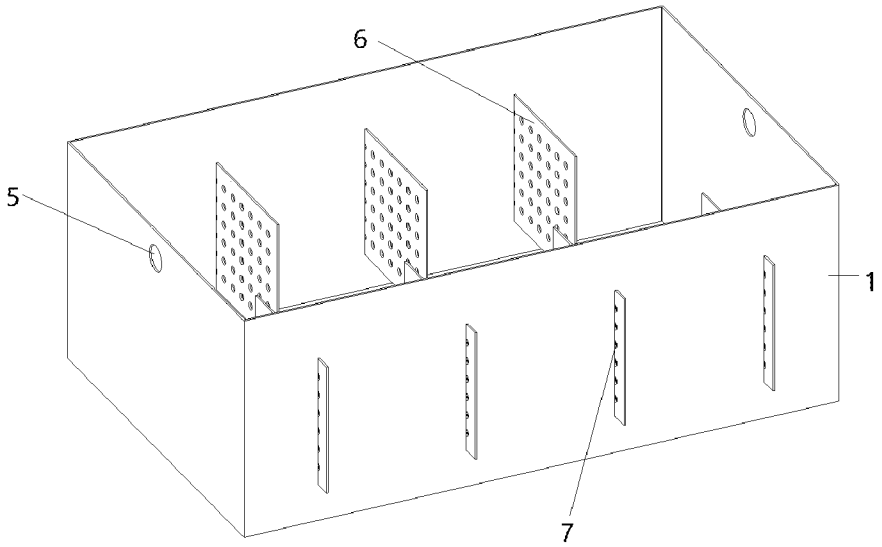
FIG. 8 is a three-dimensional effect diagram of a TLD in the construction steel platform system using a TLD and a TMD for composite tuned damping according to the present disclosure.
Figure 9:
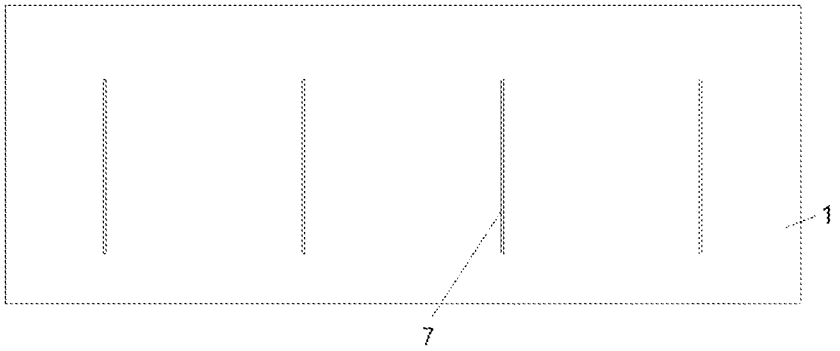
FIG. 9 is a front view of the TLD in the construction steel platform system using a TLD and a TMD for composite tuned damping according to the present disclosure.
Figure 10:
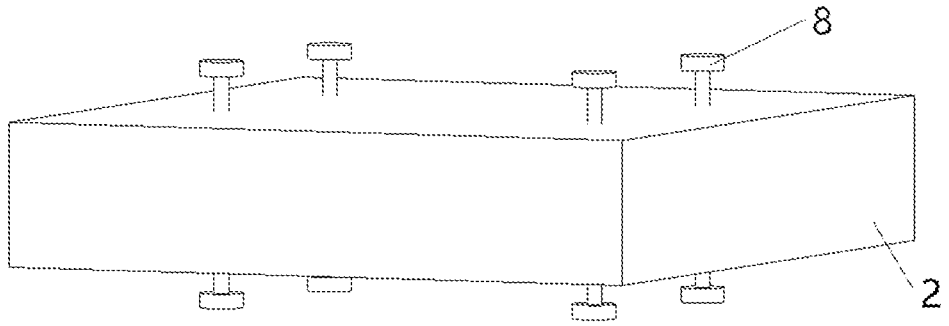
FIG. 10 is a three-dimensional effect diagram of a TMD in the construction steel platform system using a TLD and a TMD for composite tuned damping according to the present disclosure.
Figure 11:
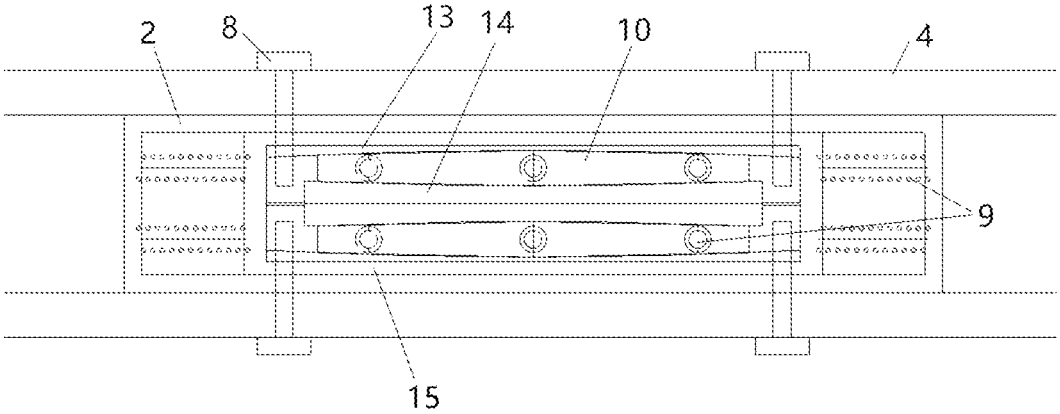
FIG. 11 is an internal cross-sectional view of the TMD in the construction steel platform system using a TLD and a TMD for composite tuned damping according to the present disclosure.
Figure 12:
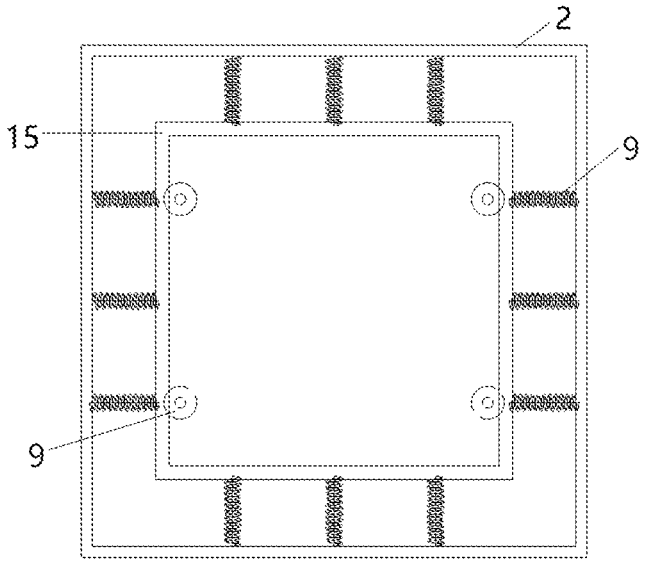
FIG. 12 is a top view of the TMD in the construction steel platform system using a TLD and a TMD for composite tuned damping according to the present disclosure.

FIG. 1 shows an embodiment of a construction steel platform system using a tuned liquid damper (TLD) and a tuned mass damper (TMD) for composite tuned damping according to the present disclosure. The construction steel platform system using a TLD and a TMD for composite tuned damping mainly includes a water tank 1, an outer TMD plate 2, a construction steel platform 3, a rigid base plate 4, a water outlet/inlet 5, a partition plate 6, a partition plate insertion opening 7, a connecting bolt 8, a spring 9, a friction sliding block 10, a steel platform and TLD connecting support 11, a TMD and bottom structure connecting support 12, an upper friction support plate 13, a lower friction support plate 14 and an inner TMD plate 15. Specific implementation steps are as follows:

A building is a high-rise frame-core tube commercial office building, with 40 floors, with a floor height of 38 m and a total height of 152 m. According to a planar area of a core tube, specifications of all components of the steel platform system are determined to meet requirements in the technical solution. Then, the construction steel platform system using a TLD and a TMD for composite tuned damping is attached to the core tube for construction.

Each TLD water tank has a length of 1.5 m, a width of 0.8 m, a height of 0.7 m and a depth of 0.5 m, and a liquid may be replaced through the water injection and drainage outlet at any time according to construction conditions. The insertable partition plate in the TLD may be replaced at any time by means of the partition plate insertion opening, a hole diameter may be changed, the partition plate has a length of 0.3 m, a width of 0.01 m and a height of 0.35 m. After the liquid in the water tank is blocked by the partition plate, the damping ratio of the water tank may be increased, such that the damping effect of the TLD on the construction steel platform is greatly improved. After measurement, the damping ratio of the construction steel platform is increased by 5 times after adding the TLD, from the original 1% to 4.8%, and displacement response is decreased by 35%-50% when the wind speed is 20 m/s.

Each TMD has a length of 1 m, a width of 0.6 m and a height of 0.5 m. The TMD overlaps the TLD, and the TMD and the TLD are connected to the rigid base plate therebetween by means of bolts to form the composite tuned damper. The TMD may achieve the optimal effect by adjusting the stiffness of the spring at the edge of the friction support and the mass of the materials of the top of the steel platform.

Every time the core tube in five floors is newly built, a first-order natural vibration frequency of a main structure is measured, and mass of the whole steel platform, an upper apparatus and the building materials are kept constant during construction. It is necessary to adjust a liquid level height of the TLD water tank and the hole diameter of the partition plate. The natural vibration frequency of the whole steel platform relative to the core tube may be changed by the stiffness of the spring in the TMD and the mass of the material in the material stacking area. Assuming that an earthquake occurs when the 25th floor of the core tube is constructed, the first-order natural vibration frequency of the core tube is 2.70 Hz, and a sum of the stiffnesses of the springs in all TMDs may be calculated by a formula of the natural vibration frequency should be 6,400 kN/m. As the whole platform is arranged by means of four distributed TMDs, each TMD has 24 variable stiffness springs, the whole platform is connected to the TMDs in parallel by means of 96 springs, the stiffness of each spring should be changed to 66.67 kN/m, and in this case, the natural vibration frequency of the whole steel platform is 2.4 Hz.

When the wind occurs, the composite tuned damper composed of the TLD and the TMD may effectively dissipate energy and achieve damping. A vibration acceleration index may meet international residential comfort standards, and the damping effect is remarkable. The composite tuned effect of the steel platform system has a desirable control effect on vibration of the core tube during construction, and the vibration energy is absorbed such that displacement of the top of the core tube under storm is well controlled. Compared with the case of absent damping, a peak acceleration decreases by 16.7%, and the horizontal displacement damping rate of the construction steel platform reaches 27.2%, thereby protecting safety of the building and workers.

When the wind is small, the water in the TLD water tank may be used as domestic water or fire water, which may effectively solve the problem of space occupation. Moreover, the TLD uses pure water, has low cost, and provides water sources and fire protection convenience for constructors. The top of the steel platform is divided into different functional zones, the area above the TMD is divided into areas such as a material stacking area, and building materials may be placed in the area according to the specific construction conditions. The building materials may serve as TMD mass blocks, so as to assist the TMD in tuning the mass for damping. In this case, the TLD and the TMD may be flexibly combined in series or in parallel according to the actual wind load and earthquake load requirements, which may more effectively reduce the vibration of the construction steel platform system under the wind load or the earthquake load. The design is very reasonable.

What is described above is a typical embodiment of the present disclosure, but the present disclosure is not limited thereto during implementation.

What is claimed is:

1. A construction steel platform system using a tuned liquid damper (TLD) and a tuned mass damper (TMD) for a composite tuned damping, comprising a water tank, an outer TMD plate, a construction steel platform, a rigid base plate, a water outlet/inlet, a partition plate, a partition plate insertion opening, a connecting bolt, a spring, a friction sliding block, a steel platform and TLD connecting support, a TMD and bottom structure connecting support, an upper friction support plate, a lower friction support plate and an inner TMD plate, wherein the TLD comprises the water tank, the partition plate and the water outlet/inlet, wherein the partition plate is insertable, the TMD comprises the outer TMD plate, the spring, the friction sliding block, the upper friction support plate, the lower friction support plate and the inner TMD plate, the TLD and the TMD are configured to be combined in series or in parallel according to requirements from a structure for a wind load and an earthquake load, to form the construction steel platform system for the composite tuned damping, the construction steel platform system is flexible, and the construction steel platform system is configured to reduce a vibration of the construction steel platform system under the wind load or the earthquake load.

2. The construction steel platform system using the TLD and the TMD for the composite tuned damping according to claim 1, wherein the water tank, the partition plate and the water outlet/inlet form the TLD, an overall height of the partition plate is controlled to be 0.5-0.8 times a height of the water tank, and a water stop is arranged in the partition plate insertion opening to prevent a water leakage after the partition plate is inserted, and water is injected into the water tank, the partition plate is replaceable at will, the partition plate is provided with a hole, a hole diameter is equal to 1/20-1/30 of a width of double-layer partition plates, TLDs under the construction steel platform system are distributed to form a distributed TLD system to perform a damping on the construction steel platform in a plurality of directions, and to absorb vibration energy in the plurality of directions.

3. The construction steel platform system using the TLD and the TMD for the composite tuned damping according to claim 2, wherein a first rigid base plate is arranged on the distributed TLD system and the first rigid base plate is connected to a distributed TMD system by the connecting bolt, a planar area of the first rigid base plate is more than five times a planar area of a single TLD, a second rigid base plate of the same specification as the first rigid base plate is arranged on the distributed TMD system, and the second rigid base plate is connected to the distributed TMD system by the connecting bolt, a plurality of TMDs are evenly distributed between the first rigid base plate and the second rigid base plate to form the distributed TMD system, the TMD comprises the outer TMD plate, the spring, the friction sliding block, the upper friction support plate, the lower friction support plate and the inner TMD plate, wherein an upper layer of the second rigid base plate is configured to horizontally slide along the distributed TMD system by the upper friction support plate, a large-scale construction steel platform is placed on the upper layer of the second rigid base plate, and the construction steel platform system is configured to slide horizontally on the second rigid base plate to achieve a tuned mass damping function.

4. The construction steel platform system using the TLD and the TMD for the composite tuned damping according to claim 1, wherein a top of the construction steel platform is divided into different functional zones, a portion of the different functional zones is configured to be used as material stacking areas, the TMD is placed below each of the material stacking areas, a mass of building materials in the material stacking areas is configured to serve as a mass block of a distributed TMD system, wherein in different construction stages, a first-order frequency of the construction steel platform system is adjusted by increasing or decreasing the mass of the building materials to flexibly achieve a tuned function, the friction sliding block is annular and arranged between a lower surface of the upper friction support plate and a top surface of the lower friction support plate, the friction sliding block has a thickness being 1-1.5 times a thickness of the lower friction support plate, the upper friction support plate, the lower friction support plate and the friction sliding block form a damping system, two damping systems are arranged in a vertically symmetric manner to form a damping portion of the TMD, the friction sliding block is made from a high-strength steel, or a high-strength alloy, an elastic modulus of the friction sliding block is greater than $3.2\times10^5$ N/mm$^2$ and a dynamic friction coefficient of the friction sliding block does not exceed 0.10, symmetric variable stiffness springs on four sides are arranged between the outer TMD plate and the inner TMD plate, a stiffness of each of the symmetric variable stiffness springs is adjusted in time according to a first-order frequency of a main building structure during a construction, and a ratio of the first-order frequency of the whole construction steel platform system above the upper friction support plate of a main platform to the first-order frequency of the main building structure is controlled to fall within 0.80-1.00.

5. The construction steel platform system using the TLD and the TMD for the composite tuned damping according to claim 1, wherein the TLD and the TMD are flexibly combined in series or in parallel according to requirements of the wind load and the earthquake load, when the TLD and the TMD are combined in a serial connection, the TMD and the TLD overlap each other without a support, and the TMD and the TLD are connected by the rigid base plate, a damping range of the spectrum is broadened by the serial connection to achieve a damping effect, when the TMD and the TLD are combined in a parallel connection, the construction steel platform is connected to the TLD by the steel platform and TLD connecting support, the TMD is connected to a bottom structure under the TLD by the TMD and bottom structure connecting support to form a parallel type composite tuned damping form, and the steel platform and TLD connecting support and the TMD and bottom structure connecting support are configured to be flexibly disassembled, wherein the TLD and the TMD are configured to be flexibly changed from the serial connection to the parallel connection, to achieve a damping control over the construction steel platform system.

6. The construction steel platform system using the TLD and the TMD for the composite tuned damping according to claim 3, wherein firstly, a portion of vibration energy caused by the earthquake load or the wind load is absorbed by a liquid sloshing in the distributed TLD system, then a remaining vibration energy is further absorbed by a friction sliding between the spring and the friction sliding block of the distributed TMD system above the distributed TLD system, and the TLD and the TMD constitute a composite tuned damping damper configured for controlling a vibration response of the construction steel platform system.

* * * * *